US005447088A

United States Patent [19]

Mester

[11] Patent Number: 5,447,088

[45] Date of Patent: Sep. 5, 1995

[54] DRUMSTICK GRIP

[76] Inventor: Donald M. Mester, 52296 Central Ave., South Bend, Ind. 46637

[21] Appl. No.: 328,007

[22] Filed: Oct. 24, 1994

[51] Int. Cl.[6] ..... G10D 13/02

[52] U.S. Cl. ..... 84/422.4

[58] Field of Search ..... 84/422.4

[56] References Cited

U.S. PATENT DOCUMENTS 3,608,419 9/1971 Russell ..... 84/422.4

*Primary Examiner*—Steven L. Stephan
*Assistant Examiner*—Cassandra C. Spyron
*Attorney, Agent, or Firm*—Brett A. Schenck

[57] ABSTRACT

A drumstick having a grip disposed around its handle portion. The grip comprises a layer of adhesive applied to the handle portion with sand being applied to the adhesive layer and a rubberlike coating coating the sand such that the surface of the coating is rough thereby preventing the drumstick from slipping from the hand of a user.

13 Claims, 4 Drawing Sheets

DRUMSTICK GRIP

BACKGROUND OF THE INVENTION

The present invention relates to a permanent grip for a drumstick and the method for making the grip.

While playing the drums, the hands of drummers often get very sweaty causing the drumstick to slip hindering the performance. Often tape is applied to the handle portion of the drumstick to prevent slippage. However, the tape is usually expensive, difficult to apply, and is subject to being torn or stretched leading to rapid wear.

Hence, it is an object of this invention to provide a drumstick with a permanent grip on the handle portion and a simple and inexpensive method to produce the grip that solves these problems.

SUMMARY OF THE INVENTION

The present invention is directed to a drumstick having a grip disposed around the handle portion. The grip is formed by applying an adhesive layer on the handle portion and then rolling the handle portion in a pile of very fine granular particles so that they adhere thereto. Then, the granular particles are coated with a resilient, flexible, and rubberlike coating such that the surface of the coating is rough thereby preventing the drumstick from slipping from the hand of a user.

BRIEF DESCRIPTION OF THE DRAWINGS

These and other features, aspects and advantages of the present invention will become better understood with regard to the following description, appended claims, and accompany drawings where:

DETAIL DESCRIPTION OF THE INVENTION

Figure 1:
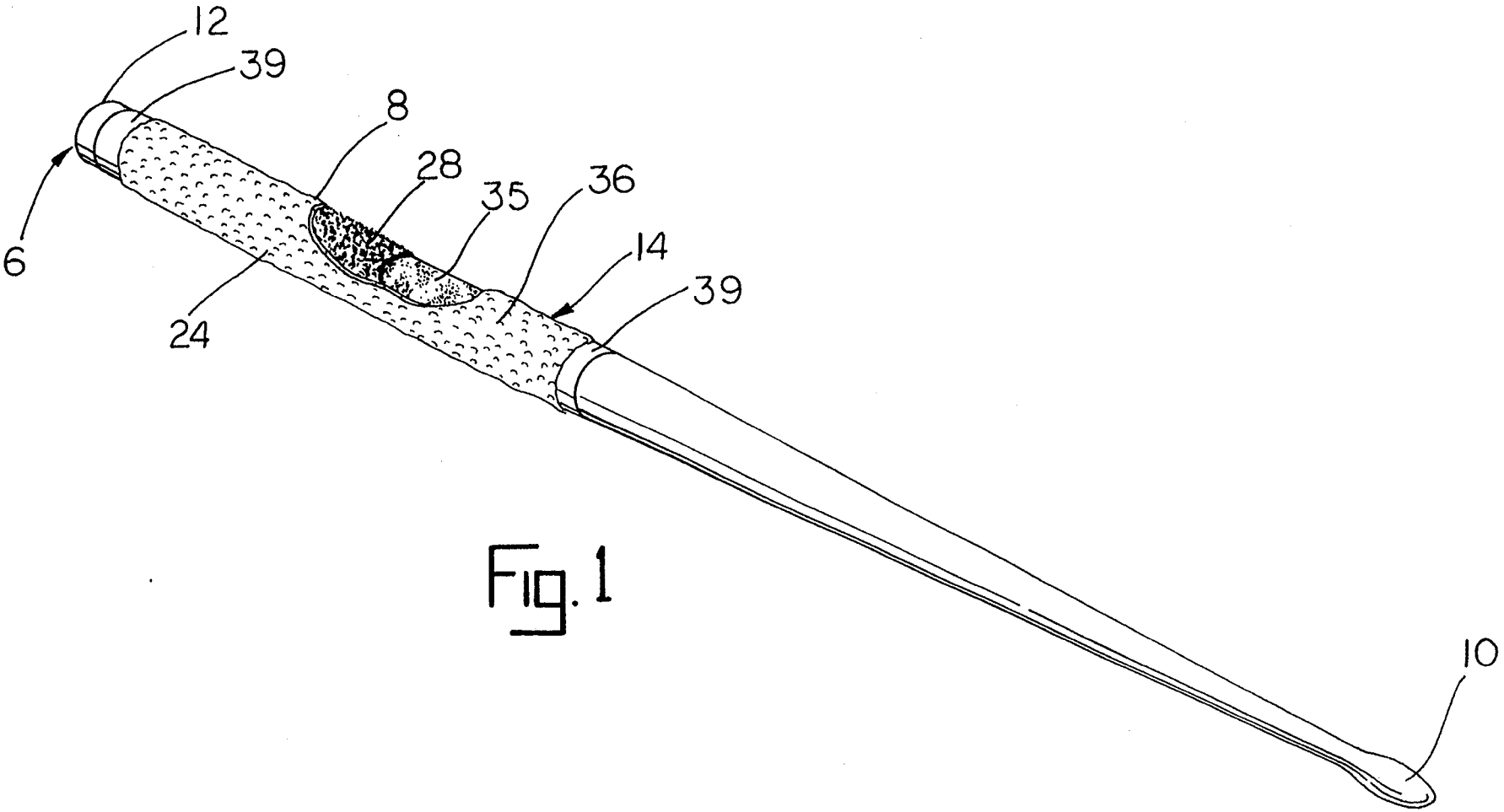
FIG. 1 is a perspective view of the drumstick with the grip shown partially in section to illustrate the grip in more detail.

FIG. 1 shows the drumstick 6 with the grip 8. The drumstick 6 generally has a tip 10 and a handle portion 14 at the butt end 12. The grip 8 is disposed around the handle portion 14 and is generally composed of a flexible, resilient, elastic and rubberlike coating 24 covering granular particles 28 that are adhered to the handle 14 by an adhesive layer 35 so that the surface 36 of the coating 24 is rough to prevent the drumstick 6 from slipping from the hand of a user.

Figure 2:
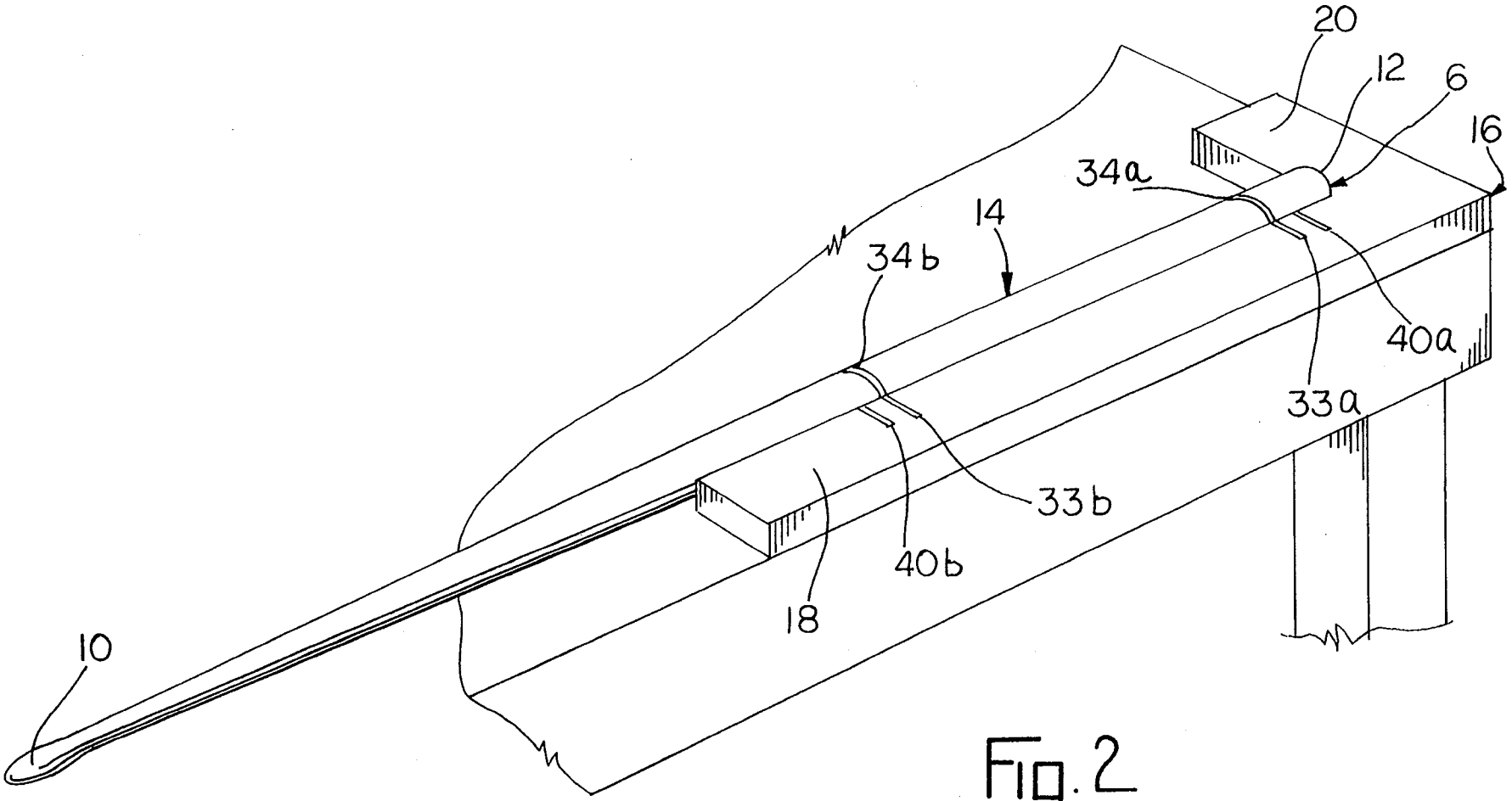
FIG. 2 is a top perspective view of the drumstick without the grip being positioned in a marking indicator.

The grip 8 is formed by first positioning the drumstick 6 inside a marking indicator 16 as shown in FIG. 2. The marking indicator 16 is generally L-shaped and can be formed by one piece of wood or by joining two pieces of wood together at right angles to each other. It should be noted that the marking indicator 16 can be composed of other materials such as metal or plastic. The marking indicator 16 has one leg 18 that includes four indicia lines 33*a*, 33*b*, 40*a*, and 40*b* embedded therein. The drumstick is positioned such that the butt end 12 abuts the leg 20 without the indicia lines and the handle portion 14 is generally parallel to the leg 18. The drumstick 6 is then marked with inner lines 34*a* and 34*b* that correspond to the inner indicia lines 33*a* and 33*b* on the leg 18 by using a pencil or other like device. The inner lines 34*a* and 34*b* on the drumstick are preferably five and one half inches apart.

Figure 3:
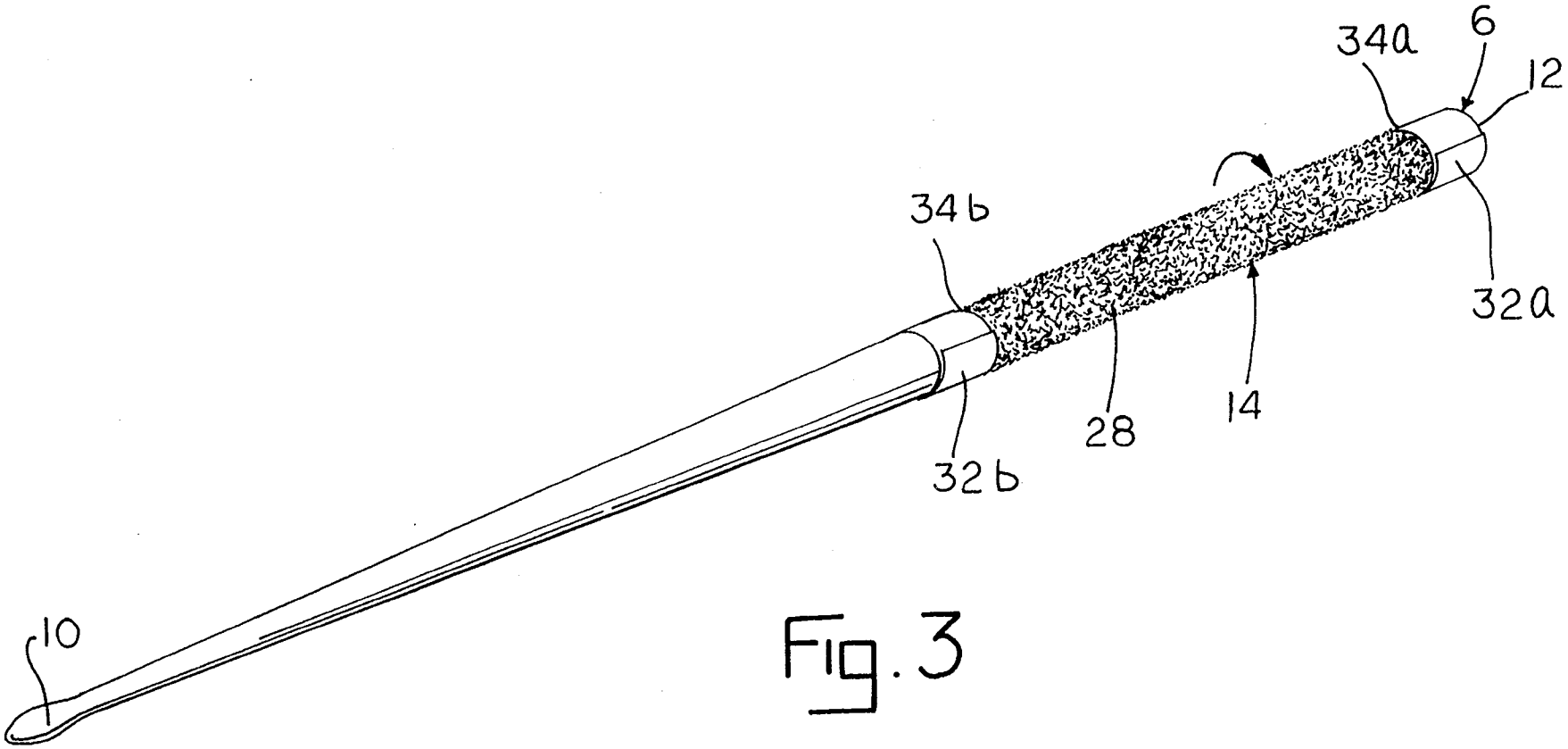
FIG. 3 is a perspective view of the drumstick with granular particles and adhesive applied to the handle portion.

Two strips of tape 32*a* and 32*b* are then wrapped around the handle portion 14 as shown in FIG. 3. One strip 32*a* is located near the butt end 12 of the handle portion 14 such that its inner end contacts the inner line 34*a*. The other strip 32*b* has its inner end contacting the other inner line 34*b*. Wood glue is then applied or sprayed evenly around the handle portion between the inner lines 34*a* and 34*b* to form an adhesive layer 35 (FIG. 1). Granular particles 28 are then applied to the adhesive layer 35 adhering thereto. The granular particles 28 are preferably composed of silica which is a very fine sand used for filtering pool water. This sand has a bulk density of 101.7 pounds per cubic feet, a hardness of 7 using Moh's scale, a specific gravity of 2.65, a Ph value of 7, an effective size of 0.48 millimeter, and a uniformity coefficient of 1.18. However, other types of sand can be used as well. To apply the granular particles 28 to the adhesive layer, the drumstick 6 can be rolled onto a pile of the granular particles or the granular particles can be poured onto the handle portion 14 as it is rolling.

The drumstick 6 is then gently tapped on a hard surface to remove small clumps of loose excess sand so that the sand is generally level around the adhesive layer 35 of the handle portion 14 as seen in FIG. 3. The glue is then let to dry for about an hour. The strips of tape 32*a* and 32*b* are then removed. As can be seen by FIG. 3, the strips of tape function to prevent glue and/or sand from adhering to the area of the handle portion outside that area between the inner lines 34*a* and 34*b*.

Figure 4:
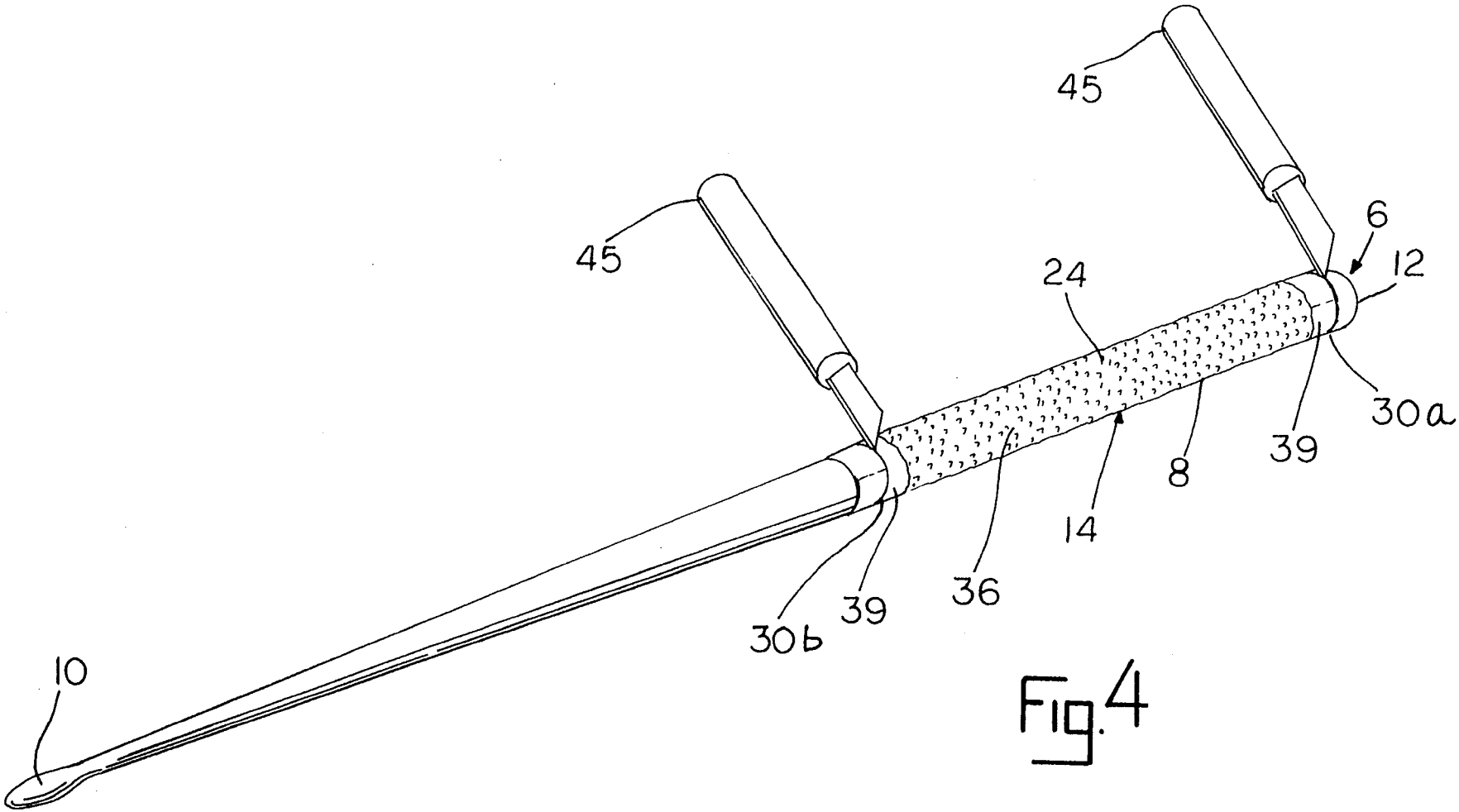
FIG. 4 is a perspective view of the drumstick with the coating being trimmed.

The handle portion 14 is then coated with a coating 24 composed of Naphtha, Hexane, Toluene, and methyl ethyl ketone, commony known as PLASTI DIP, by preferably dipping the handle portion 14 into a container of the coating in liquid form. The coating 24 is allowed to dry for about a day until it becomes flexible, resilient and rubberlike, and its outer surface 36 between the inner lines 34*a* and 34*b* is rough and bumpy due to outward projections form by the granular particles 28 as seen in FIG. 4. The drumstick is then position in the marking indicator 16 (FIG. 1) and marked with outer lines 30*a*, 30*b* (FIG. 4) that correspond to the outer indicia lines 40*a*, 40*b* of the marking indicator 16. The outer lines 30*a* and 30*b* are each approximately one eigth of an inch from its respective inner line closest to it. The outer line 30*a* near the butt end 12 is generally located one fourth of an inch down from the butt end. A razor blade or other cutting member 45 is then use to cut or trim the portions of the coating out away from each of the outer lines 30*a*, 30*b* forming similar smooth end portions 39 that are lowered or tapered due to the absence of granular particles underneath them as shown in FIG. 4.

Additional changes and modifications to the embodiment of the invention as described herein can also be made, as will be apparent to those skilled in the art, while still remaining within the spirit and scope of the disclosed invention as set forth in the appended claims. For example, the coating can be sprayed on the granular particles by an spray gun or other appropriate apparatus.

What is claimed is:

1. A drumstick having a handle portion, a grip being disposed on said handle portion, said grip comprising:

a plurality of granular particles generally evenly distributed on said handle; and a coating covering said granular particles to form a rough surface of said coating thereby preventing the drumstick from slipping from the hand of a user.

2. A drumstick having a handle portion, a grip being disposed on said handle portion, said grip comprising:

an adhesive layer applied around said handle portion;

a plurality of granular particles being applied to said adhesive layer; and a resilient coating covering said granular particles to form a rough surface of said coating thereby preventing the drumstick from slipping from the hand of a user.

3. The drumstick of claim 2 wherein said coating is of a relatively rubberlike material.

4. The drumstick of claim 2 wherein said granular particles are made of silica.

5. The drumstick of claim 2 wherein said handle portion terminates into a butt end, said handle portion having an exposed area between said butt end and said grip.

6. The drumstick of claim 2 wherein said grip has lowered end portions composed of only said coating.

7. A method of making a grip on a handle portion of a drumstick comprising the steps of:

a.) applying an adhesive layer on said handle portion;

b.) applying a plurality of granular particles on said adhesive layer; and c.) coating said granular particles with a resilient coating such that the surface of said coating is rough thereby preventing the drumstick from slipping from the hand of a user.

8. The method of claim 7 wherein said granular particles are applied to said adhesive layer by rolling the handle portion of said drumstick on a pile of said granular particles.

9. The method of claim 7 further including wrapping two regions along the length of the drumstick with a strip of tape on each of said regions; wherein said applying of the adhesive layer being between the two regions.

10. The method of claim 9 further including removing the tape from the two regions after the applying of granular particles on said adhesive layer.

11. The method of claim 10 including trimming off portions of said coating beyond an area between said regions.

12. The method of claim 10 including positioning said drumstick in a marking indicator and then marking said regions prior to said wrapping.

13. The method of claim 7 wherein said granular particles are composed of silica.

* * * * *